US011147127B2

(12) United States Patent
Schlipf

(10) Patent No.: US 11,147,127 B2
(45) Date of Patent: Oct. 12, 2021

(54) DEVICE FOR CONVERTING ELECTRICITY INTO HEAT AND ELECTRIC HEATER WITH SUCH A DEVICE

(71) Applicant: TÜRK & HILLINGER GMBH, Tuttlingen (DE)

(72) Inventor: Andreas Schlipf, Tuttlingen (DE)

(73) Assignee: TÜRK & HILLINGER GMBH, Tuttlingen (DE)

( * ) Notice: Subject to any disclaimer, the term of this patent is extended or adjusted under 35 U.S.C. 154(b) by 175 days.

(21) Appl. No.: 16/359,242

(22) Filed: Mar. 20, 2019

(65) Prior Publication Data

US 2019/0297678 A1 Sep. 26, 2019

(30) Foreign Application Priority Data

Mar. 23, 2018 (DE) ..... 20 2018 101 634.2

(51) Int. Cl.
*H05B 3/26* (2006.01)
*H05B 3/16* (2006.01)
(Continued)

(52) U.S. Cl.
CPC ..... *H05B 3/262* (2013.01); *H05B 3/16* (2013.01); *H05B 3/18* (2013.01); *H05B 3/265* (2013.01);
(Continued)

(58) Field of Classification Search
CPC . H05B 3/16; H05B 3/26; H05B 3/262; H05B 3/265; H05B 3/267; H05B 2203/01
See application file for complete search history.

(56) References Cited

U.S. PATENT DOCUMENTS 1,403,330 A * 1/1922 Lightfoot ..... H05B 3/00 338/247
2,084,881 A * 6/1937 Adams ..... A47J 37/08 99/391
(Continued)

FOREIGN PATENT DOCUMENTS

CN 2540721 Y 3/2003
CN 101389162 A 3/2009
(Continued)

OTHER PUBLICATIONS

Translation of DE 10 2009 043 032 A1 (Year: 2011).*
(Continued)

*Primary Examiner* — Erin E McGrath
(74) *Attorney, Agent, or Firm* — McGlew and Tuttle, P.C.

(57) ABSTRACT

A device (100, 200, 1100, 2100) converts electricity into heat. A first flat winding support (110, 130, 210*a*, 210*b*, 230*a*, 230*b*, 310*a*, 310*b*, 330*a*, 330*b*, 510, 610, 630, 710, 1110, 1130, 2110, 2130) including electrically insulating material, has a first electric heating element (140, 150, 240*a*, 240*b*, 250*a*, 250*b*, 340*a*, 340*b*, 350*a*, 350*b*, 540, 640, 650, 740, 750) wound thereon. The first flat winding support with wound first electric heating element is inserted into a housing (190, 290, 1190, 2190) electrically insulated against the housing. A second flat winding support, including electrically insulating material, has a second electric heating element (140, 150, 240*a*, 240*b*, 250*a*, 250*b*, 340*a*, 340*b*, 350*a*, 350*b*, 540, 640, 650, 740, 750), which is galvanically separated from the first electric heating element, wound thereon. The second flat winding support with wound second electric heating element is inserted into the housing electrically insulated against the housing.

10 Claims, 15 Drawing Sheets

(51) Int. Cl.
*H05B 3/18* (2006.01)
*H05B 3/48* (2006.01)

(52) U.S. Cl.
CPC ..... *H05B 3/267* (2013.01); *H05B 3/48* (2013.01); *H05B 2203/01* (2013.01); *H05B 2203/014* (2013.01)

(56) References Cited

U.S. PATENT DOCUMENTS

| | | | | |
|---|---|---|---|---|
| 3,904,851 | A | 9/1975 | Gustafson et al. | |
| 4,326,121 | A | 4/1982 | Welsby et al. | |
| 6,297,477 | B1 * | 10/2001 | Gort-Barten | A47J 37/0807 219/386 |
| 2005/0109767 | A1 * | 5/2005 | Fennewald | H05B 3/42 219/543 |
| 2012/0234819 | A1 * | 9/2012 | Berger | H05B 3/28 219/213 |
| 2015/0021314 | A1 * | 1/2015 | Coulton | H05B 3/12 219/534 |

FOREIGN PATENT DOCUMENTS

| | | | |
|---|---|---|---|
| DE | 416 821 | A | 8/1925 |
| DE | 23 50 234 | A | 4/1974 |
| DE | 26 15 013 | A1 | 10/1977 |
| DE | 26 59 307 | C3 | 7/1980 |
| DE | 203 11 068 | U1 | 9/2003 |
| DE | 10 2009 043 032 | A1 | 3/2011 |
| GB | 632 063 | A | 11/1949 |

OTHER PUBLICATIONS

Kapton Dupont Product Data Sheet (Year: 2012).*
Polyimide Material Information (Year: 2017).*
www.peel-plate.com/en/technical-details/sheet-processing/sheet-water-jet-cutting/.

* cited by examiner

DEVICE FOR CONVERTING ELECTRICITY INTO HEAT AND ELECTRIC HEATER WITH SUCH A DEVICE

CROSS REFERENCE TO RELATED APPLICATIONS

This application claims the benefit of priority under 35 U.S.C. § 119 of German Application 20 2018 101 634.2, filed Mar. 23, 2018, the entire contents of which are incorporated herein by reference.

TECHNICAL FIELD

The present invention pertains to a device for converting electricity into heat. Such devices are used, on the one hand, in conjunction with electric heaters or as electric heaters in order to provide heat for a certain purpose, especially for heating. On the other hand, such devices are used in applications in which larger amounts of generated electricity shall be removed as rapidly as possible and are used in this application as load resistors or components of a load resistor.

BACKGROUND

The technical principle of action is the same in both cases: Electric current is sent through an electric heating element, typically a resistance wire or heat conductor, and it generates heat, which is then removed as efficiently as possible either to the object to be heated or to the surrounding area.

A typical configuration for such a device is known, for example, from DE 203 11 068 U1. It comprises essentially a flat winding support consisting of an electrically insulating material, onto which a resistance wire is wound. The winding support on which a resistance wire is thus wound is inserted into a housing such that it is ensured that an electrical insulation of the resistance wire against the housing is present. This may be brought about, for example, by at least one additional layer of insulation.

An essential drawback of the prior-art devices for converting electricity into heat, which correspond to this principle of configuration, is that they are optimized essentially for one mode of operation. For their use in heaters, this means that a plurality of heating stages cannot be achieved with them or they cannot be achieved efficiently. It follows for the use as a load resistor that a plurality of different model series, which are each configured for power consumption in a certain range, must be fabricated and stocked.

SUMMARY

An object of the present invention is to provide a device for converting electricity into heat, which can be used in a flexible manner, so that it can also be used, on the one hand, in cases with different heating stages as electric heaters and especially as an electric heater for heating a pipe and can be used, on the other hand, as a load resistor for different amounts of energy to be removed.

The device for converting electricity into heat comprises a first flat winding support consisting of an electrically insulating material, onto which a first electric heating element, usually a resistance wire or heat conductor, is wound.

An object is flat in the sense of this disclosure if its two largest surfaces, which form the flat sides, are located opposite each other and all points of one of these surfaces are located essentially at the same distance from the other of these surfaces.

The first flat winding support thus wound on is inserted into a housing such that it is ensured that an electrical insulation of the electric heating element against the housing is present, This can be achieved, for example, by a stack being formed, which has at least one additional insulation plate each on both flat sides of the flat winding support, which insulation plate covers at least the wound-on area of the flat winding support and preferably protrudes laterally, so that insulation of the long sides of the flat winding support, which extend at right angles to the flat sides of the flat winding support, is achieved against the housing.

It is essential for the present invention that the device for converting electricity into heat has at least one more, second flat winding support consisting of an electrically insulating material, onto which a second electric heating element is wound, which winding support is inserted into the housing such that it is ensured that an electrical insulation of all electric heating elements is present against the housing and, if they are not connected in parallel or in series with another, from one another.

This second electric heating element and optionally present additional electric heating elements may then be used to vary the heat output or the energy dissipation by switching over the current between the individual heating elements, especially the first electric heating element and the second electric heating element, and/or by allowing the current to flow in parallel or in series through a plurality of the electric heating elements, especially through the first electric heating element and the second electric heating element.

It should be noted that the terms "first" and "second" used are variable. They may consequently be attributed to any electric heating element and/or to any flat winding support of a given device for converting electricity into heat and they do not imply any predefined arrangement in a row, so that it is not ruled out, for example, that at least one additional free winding support is arranged between the first flat winding support and the second flat winding support.

Especially if the first electric heating element and the second electric heating element are configured for operation with different voltages, i.e., for example, one of them for operation with the on-board voltage network of a vehicle and the other a line voltage, it may be considered to be advantageous if the electrical insulation for the galvanic separation of the first electric heating element from the second electric heating element has a higher dielectric strength than the electrical insulation of the electric heating elements against the housing. The especially high requirements on the electrical insulation of such different networks from one another can be met in this manner with manageable effort.

A dielectric strength of several thousand V should preferably be reached especially between the first electric heating element and the second electric heating element.

It is especially preferred in this connection if the wound-on first flat winding support and the wound-on second flat winding support are parts of a stack. Provisions are made in a variant of this configuration for at least one insulation plate consisting of an electrically nonconductive material, for example, Micanite, and/or at least one insulation mat and/or an insulation film, for example, a polyimide film or a Nomex film, which are arranged between the respective electrical heating elements, with which the wound-on flat winding supports are wound on, to be present in the stack for insulating two mutually adjacent, wound-on flat winding supports from one another and for ensuring galvanic separation. The use of insulation plates, webs of insulation mats and/or webs of insulation films and especially the use of stacks of these components represents a reliable, defined and yet technologically simple solution for insulation and for bringing about galvanic separation.

Using at least also a web of an insulation mat and/or an insulation film is highly advantageous especially if the device for converting electricity into heat is exposed to mechanical loads, as they occur to a special extent when the device for converting electricity into heat is shaped, e.g., bent. It may happen in this connection that insulation plates will crack or break, which leads to a local reduction of the dielectric strength. An insulation mat and/or an insulation film can effectively prevent this.

According to a preferred variant of the present invention, the first electric heating element and the second electric heating element are wound on differently, for example, with different pitches, so that electric heating elements of different lengths are arranged on winding supports of equal length, and/or the first electric heating element and the second electric heating element possess different physical properties. These may comprise especially a different cross section of resistance wires consisting of the same material and/or of different materials of the electric heating elements, especially of resistance wires. A substantial change can be achieved in this manner in the heat output and in the load dissipation depending on which of the heating circuits or load dissipation circuits represented by the respective winding support, onto which an electric heating element is wound, is operated.

It proved to be advantageous in this connection to make the electrical insulation of mutually adjacent winding supports by the use of a plurality of insulating materials in the form of insulation plates, especially Micanite plates, and/or webs of insulation mats and/or insulation films, for example, a polyimide film or a Nomex film, between the two mutually adjacent, wound-on flat winding supports to be insulated from one another. Such a multipart configuration of the implementation of a desired electric strength likewise shows its advantages especially if mechanical stresses occur, because cracking occurs in several insulation plates under such conditions in the normal case at different points. As a consequence, through cracking, which may occur when a single, but now correspondingly thicker insulation plate is used, which use is, of course, possible, in principle, and is actually obvious, is avoided through a multipart, stacked configuration of the insulation to the greatest extent possible.

It is especially preferred if the first electric heating element and the second electric heating element are provided each with separate terminals. This maximizes the number of modes of operation, in which the device for converting electricity into heat can be operated.

It is advantageous for many applications if both terminals of the first electric heating element and/or both terminals of the second electric heating element are located each at the same end of the first and/or second flat winding support.

One possibility of achieving this in an electric heating element wound onto a flat winding support is that at least one of the terminals of an electric heating element is returned next to the winding from the end of the flat winding support, at which the end of the winding is located, to the end of the flat winding support, at which the beginning of the winding is located. This is preferably brought about via a return conductor, made of a punched, water-cut (www.peel-plate.com/en/technical-details/sheet-processing/sheet-water-jet-cutting/), hydrogen-cut or laser-cut sheet metal, which may especially preferably consist of steel, stainless steel, aluminum or copper.

It proved to be advantageous in this connection if at least two of the terminals of an electric heating element are returned next to the winding from the end of the flat winding support, at which the end of the winding is located, to the end of the flat winding support, at which the beginning of the winding is located, the return extending on different sides next to the winding in case of adjacent electric heating elements.

Another possibility of achieving this in case of an electric heating element wound on a flat winding support is that at least one of the electric heating elements is returned from the end of the first flat winding support, at which the end of the winding is located, to the end of the flat winding support, at which the beginning of the winding is located, by winding the electric heating element onto another flat winding support in the opposite winding direction, wherein the winding of the electric heating element, which is wound onto the first flat winding support, is electrically insulated from the winding of the electric heating element, which is wound onto the additional flat winding support. This electrical insulation can also be brought about especially by having at least one additional insulation plate between the two flat winding supports, which covers at least the wound-on area of the flat winding supports and possibly optionally protrudes over it laterally, so that an insulation of the long sides of the flat winding support, which extend at right angles to the flat sides of the flat winding support, is achieved against the housing.

In a variant of this variant, the first flat winding support and/or the additional flat winding support have structures on the end face facing away from the terminals of the electric heating element, via or through which structures the electric heating element is guided over its course from the first flat winding support to the second flat winding support, which facilitates the arrangement of the electric heating element on the respective winding support and improves the stability of this arrangement.

At least one of the flat winding supports is preferably formed by a stack of insulation plates. The length of the heating element, which can be accommodated on this winding support, can be increased in this manner. Moreover, such an arrangement also makes it, however, possible to arrange galvanically mutually separated electric heating elements in a "sandwich-like" manner, i.e., such that another winding support, on which an electric heating element is wound, is located between two insulation plates, which belong to a multipart flat winding support.

Such an arrangement is configured in an especially preferred variant of the present invention such that electric heating elements with a lower heat output and/or electric heating elements that are intended for the operation with a lower operating voltage are arranged farther outside, i.e., farther away from the body to be heated than are electric heating elements with a higher heat output and/or electric heating elements that are intended for the operation with a higher operating voltage.

The overall arrangement of the device for converting electricity into heat is preferably compacted or compressed. This can preferably lead to a gap-free arrangement of the components in the interior of the housing, in which the electric heating elements are then especially also pressed into insulation supports and/or winding supports, which leads to a further improvement of their insulation.

It is especially preferred in this connection if the compaction and/or compression take place to a lesser extent in the area of the terminals, which is achieved especially preferably if the housing has a larger cross section in the area of the terminals, so that it has a step when viewed from the outside.

The electric heater according to the present invention for heating a body, especially a pipe, is characterized in that it has a device for converting electricity into heat comprises a housing, a first flat winding support comprised of an electrically insulating material, first electrical insulation, a first electric heating element wound on the first flat winding support, the first flat winding, supported in a wound state on the first flat winding support, being disposed in the housing electrically insulated relative to the housing by the first electrical insulation, a second flat winding support comprised of an electrically insulating material, second electrical insulation, further electrical insulation and a second electric heating element wound on the second flat winding support galvanically separated from the first electric heating element by the further electrical insulation, the second electric heating element being disposed in the housing electrically insulated relative to the housing by the second insulation such that first electric heating element and the second electric heating element are electrically insulated relative to the housing. It is especially preferred in this connection that the device for converting electricity into heat is shaped such that a section of the housing of the device for converting electricity into heat is in contact with an outer contour of the body. Such an electric heater may advantageously be used especially for operating absorption refrigerators, which are used, for example, for minibars or in mobile homes, because a plurality of modes of operation can be achieved by means of them in an extremely compact arrangement.

In a preferred variant of this electric heater for heating a pipe, the device for converting electricity into heat is shaped into a U-shaped form, and an arc of the U is adapted semicircularly to the outer contour of the pipe and the legs of the U extend away from the central plane of the body, especially pipe, at right angles to a central plane of the body, especially pipe, in which plane a central axis of the body, especially pipe, is located. Not only is it possible in this manner to improve the seating of the electric heater on the body, especially pipe, but the heating effect attained can, moreover, also be optimized, while the possibility of removal still remains simple, if the electric heater is configured such that the legs of the U are heated as well.

The present invention will be explained in more detail below on the basis of the figures, which show exemplary embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
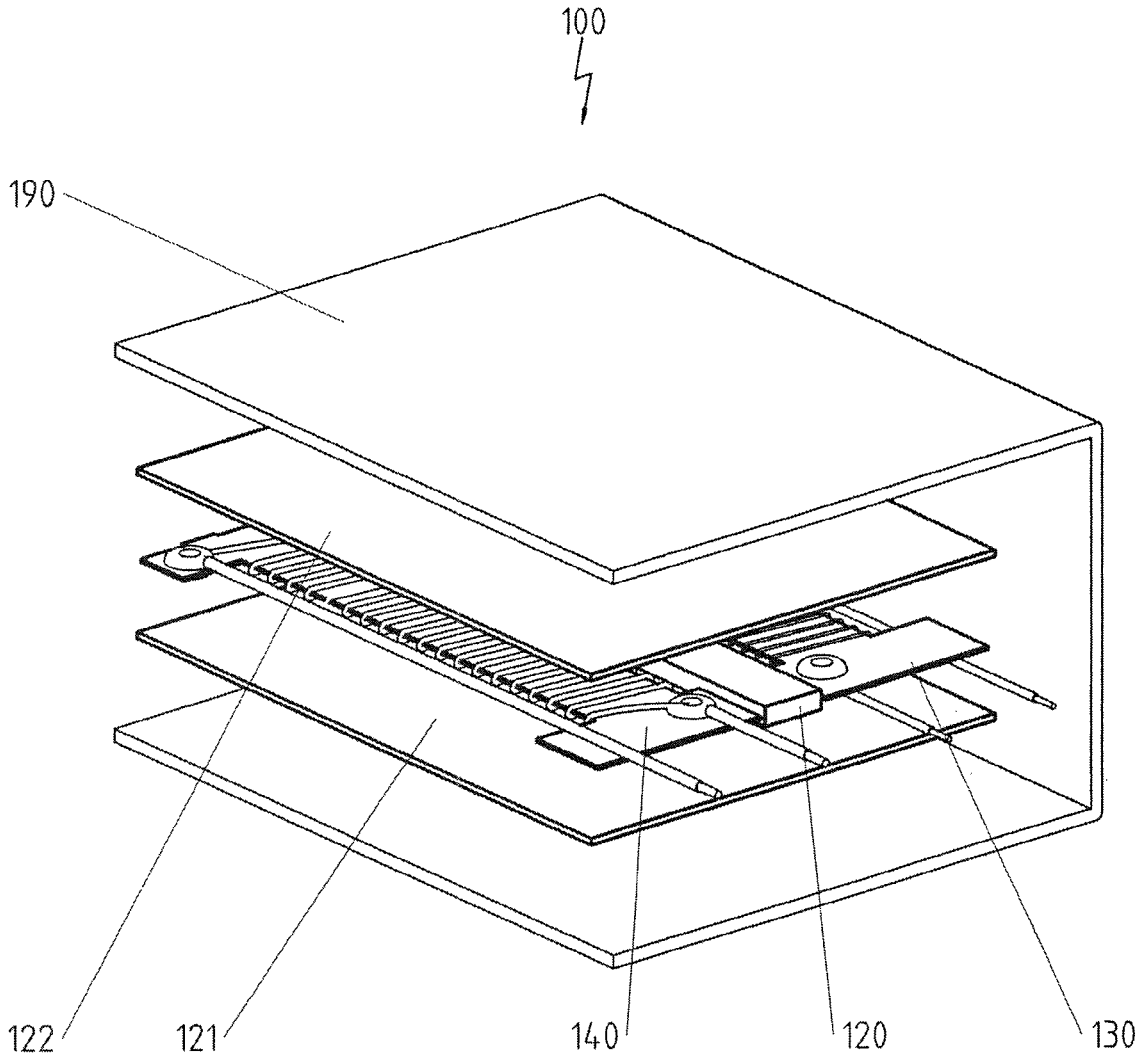
FIG. 1 is a perspective partially opened exploded view showing a first device for converting electricity into heat.

Referring to the drawings, not all reference numbers are shown in all figures for the sake of clarity. Identical components of the same exemplary embodiments have the same reference numbers in all figures unless indicated otherwise.

Figure 2:
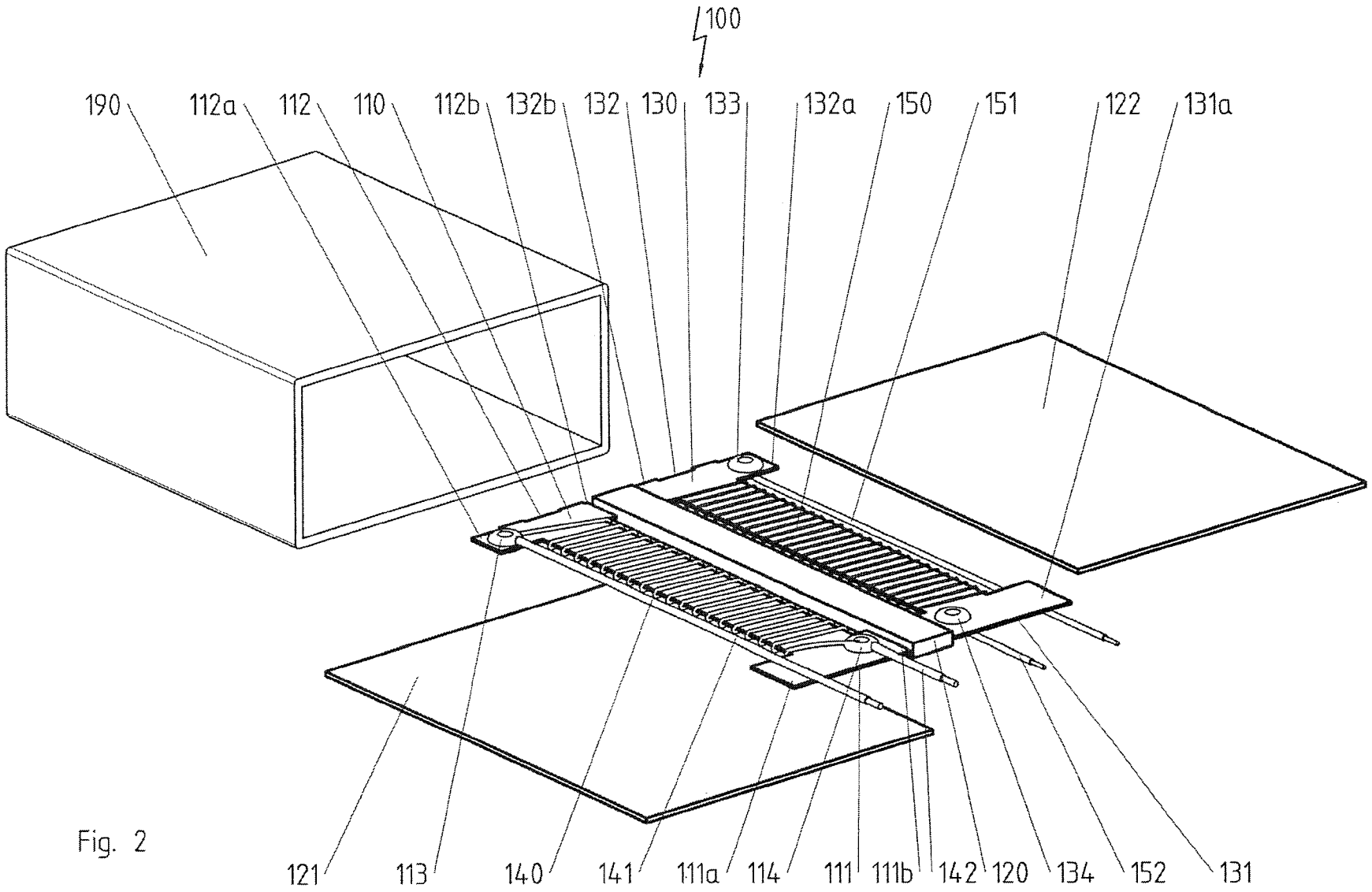
FIG. 2 is a perspective view showing the components of which the device from FIG. 1 is composed.

FIGS. 1 and 2 show a first exemplary embodiment of a device 100 for converting electricity into heat. The device 100 has a housing 190, in the interior of which two respective winding supports 110, 130, onto which a respective electric heating element 140, 150 is wound, are embedded. The device 100 is shown in the exploded view in FIG. 1, so that the distance between the individual components in the vertical direction is shown as being exaggeratedly great in order to allow a more detailed representation of the components.

Depending on how the electric heating element 140, 150 is configured, especially in terms of the selected material and the cross section, and on how the winding supports 110, 130 are wound on, especially in terms of the number of turns and the winding pitch, heating circuits with different heat outputs can thus be provided in a very simple manner, and these heating circuits permit, depending on the actuation, different operating stages, or it is also possible to provide heating circuits for use with different voltage sources, e.g., the on-board voltage network of a vehicle, on the one hand, and the normal stationary a.c. voltage network, on the other hand.

While it is also possible, in principle, to use rectangular or strip-shaped winding supports 110, 130, these always have projections 111*a*, 111*b*, 112*a*, 112*b*, 131*a*, 131*b*, 132*a*, 132*b*, which locally broaden the winding support 110, 130, in both end areas 111, 112 and 131, 132 in the exemplary embodiment shown, and the broadening is greater in this exemplary embodiment in one direction due to the projections 111*a*, 112*a*, 131*a*, 132*a* than the broadening in the other direction due to the projections 111*b*, 112*b*, 131*b*, 132*b*.

All projections 111*a*, 111*b*, 112*a*, 112*b*, 131*a*, 131*b*, 132*a*, 132*b* have the purpose of ensuring that the electric heating element 140, 150, with which the respective winding support 110, 130 is wound on, is spaced apart from the housing 190.

The projections 111*a*, 112*a*, 131*a*, 132*a* have, moreover, the function of making possible an electrical connection of the two ends of the electrical heating elements 140, 150 configured as a heating wire on the same side of the device 100 for converting electricity into heat by establishing a contact to a terminal wire 141, 151, which is returned to the terminal side parallel to the winding direction and spaced apart from the winding by the projections 111*a*, 112*a*, 131*a*, 132*a*, from the end of the winding, which end is opposite the terminal side, as is shown in the exemplary embodiment, via a contact point 113, 133 provided on the winding support 110, 130.

It is, however, also possible, as an alternative to this, to return an end section of the electric heating elements 140, 150 parallel to the winding direction and through the projections 111*a*, 112*a*, 131*a*, 132*a* spaced apart from the winding to the terminal side and to establish the connection to a terminal wire there.

The other end of the electric heating elements 140, 150 is electrically connected to an additional terminal wire 142, 152 via a contact point 114, 134 provided at the terminal-side end of the winding support 110, 130. The electrical connection at a contact point 114, 134 may be established especially by welding, riveting, crimping or soldering not only in this exemplary embodiment but quite generally as well.

The wound-on winding supports 110, 130 are arranged next to each other in the device 100 for converting electricity into heat and are part of a stack, which also contains, moreover, electrically insulating insulation plates 120, 121, 122, which should, however, preferably have the best possible heat conduction. The insulation plates 120, 121, 122 may consist, for example, of Micanite.

The electric heating elements 140, 150 are electrically insulated from one another by the insulation plate 120 and a galvanic separation is thus guaranteed between the electric heating elements 140, 150 especially in the area of the winding supports, while the electrical insulation of the electric heating elements 140 and 150 from the housing 190 is ensured by the insulation plates 121 and 122, respectively. However, individual insulation plates 120, 121, 122 or all insulation plates 120, 121, 122 may, in principle, also be insulated from one another and from the housing 190 by embedding in an electrically insulating, but heat-conducting powder or granular material, for example, magnesium oxide. The overall arrangement is preferably compressed together in both cases. This may preferably lead to a gap-free arrangement, in which the electric heating elements are then especially also pressed into insulation supports and/or winding supports.

Figure 3B:
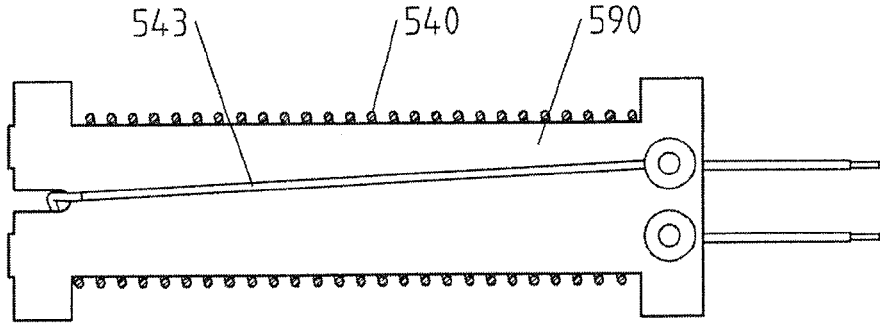
FIG. 3*b* is a bottom view showing the upper winding support of the configuration variant from FIG. 3*a;*
Figure 3A:
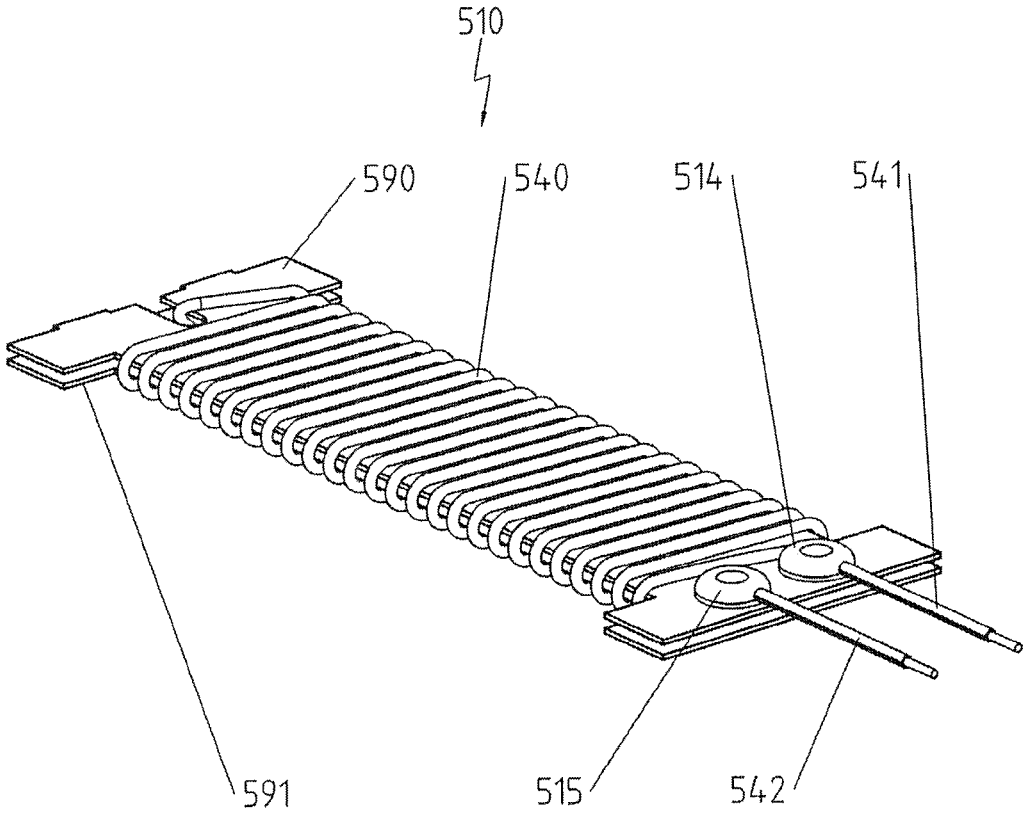
FIG. 3*a* is an oblique view from the top showing a configuration variant for a wound-on winding support.

In two different perspectives, FIGS. 3*a* and 3*b* show an embodiment variant for a wound-on winding support 510, which can be used in all exemplary embodiments as an alternative to the winding supports shown there. The winding support 510 has a multipart configuration and comprises especially an upper insulation plate 590 and a lower insulation plate 591. Additional insulation plates may optionally also be arranged between the upper insulation plate 590 and the lower insulation plate 591. The winding support 510 is consequently configured as a stack of a plurality of insulation plates 590, 591.

The electrical heating element 540 is wound in this configuration on the multipart winding support 510 thus formed around this stack of insulation plates, i.e., around the upper insulation plate 590 and the lower insulation plate 591 in the exemplary embodiment shown and is connected to terminal wires 541, 542 via contact points 514, 515.

The multipart configuration of the winding support 510 has especially two effects:

On the one hand, it is made possible hereby that, as is shown especially clearly in FIG. 3*b*, the end section 543 of the electric heating element 540 is returned in an electrically insulated manner between the upper insulation plate 590 and the lower insulation plate 591.

On the other hand, the length of the electric heating element 540 wound on the winding support can be increased due to a multipart, stack-like configuration of the winding support 510, which may represent an important degree of freedom for providing a desired heat output.

FIGS. 4*a* through 4*j* show a second exemplary embodiment of a device 200 for converting electricity into heat. The device 200 has a housing 290, in the interior of which four winding supports 210*a*, 210*b*, 230*a*, 230*b*, on which a respective electric heating element 240*a*, 240*b*, 250*a*, 250*b* is wound in the form of a heat conductor, are embedded. The electric heating elements 240 and 240*b*, on the one hand, and the electric heating elements 250*a* and 250*b*, on the other hand, are connected here in series, so that two heating circuits are likewise formed.

Figure 4A:
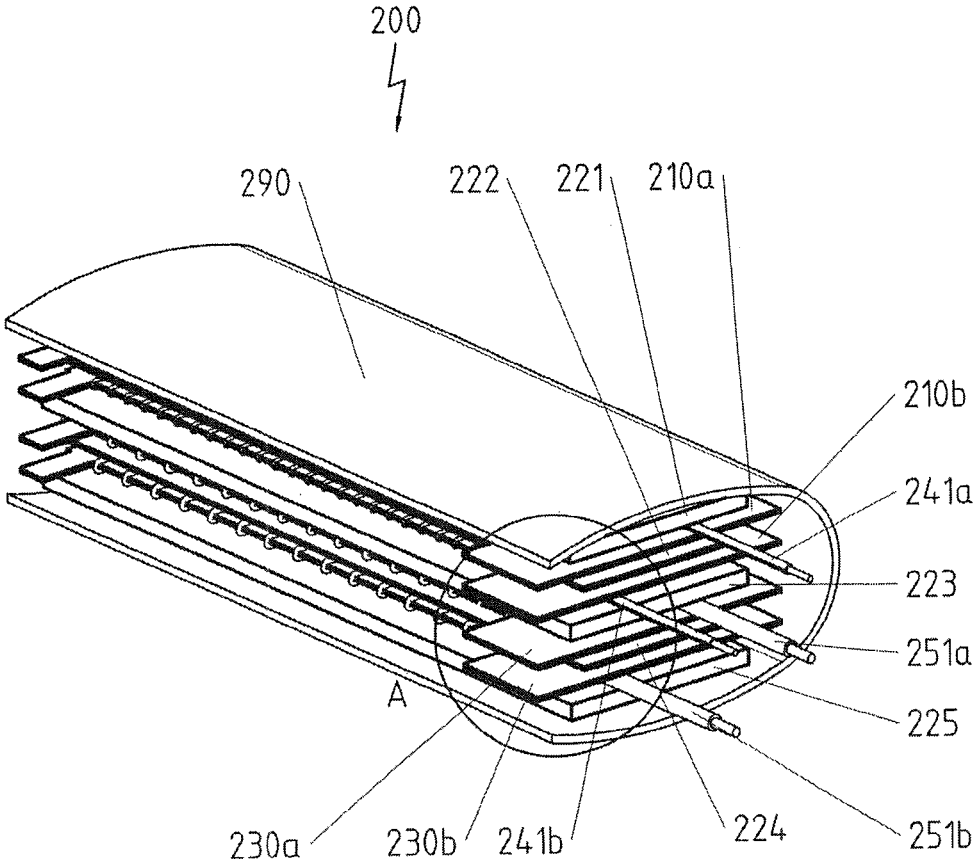
FIG. 4*a* is a perspective partially opened view of a second device for converting electricity into heat.
Figure 4B:
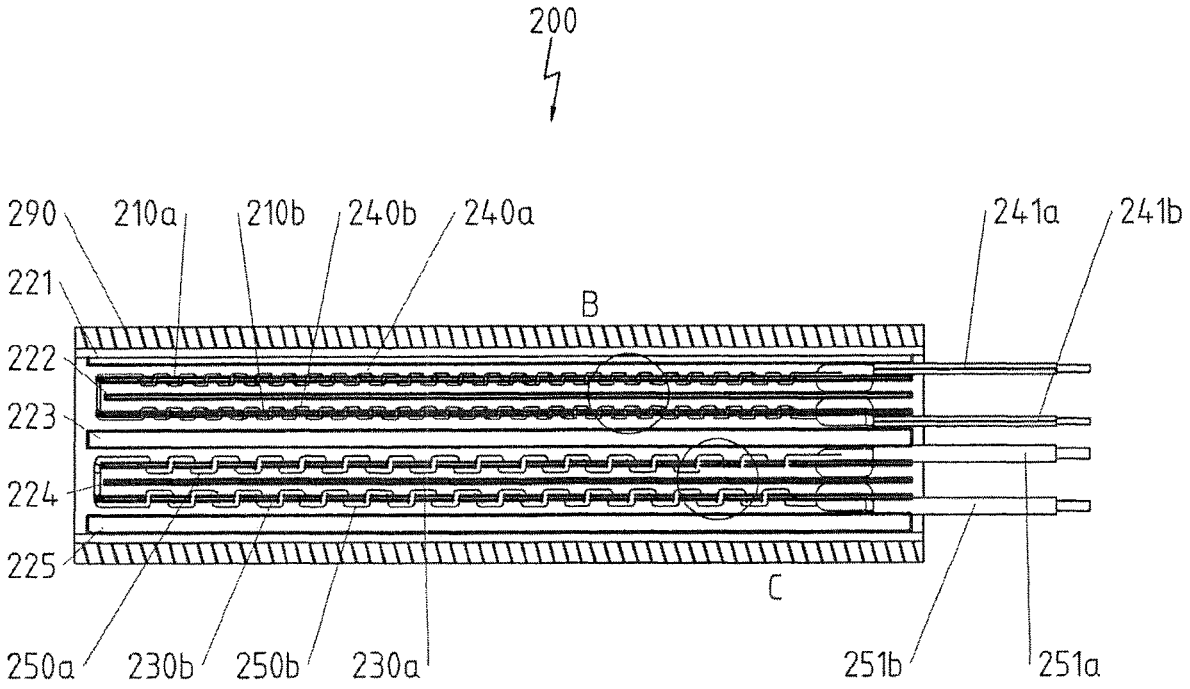
FIG. 4*b* is a side sectional view of the device for converting electricity into heat from FIG. 4*a;*
Figure 4C:
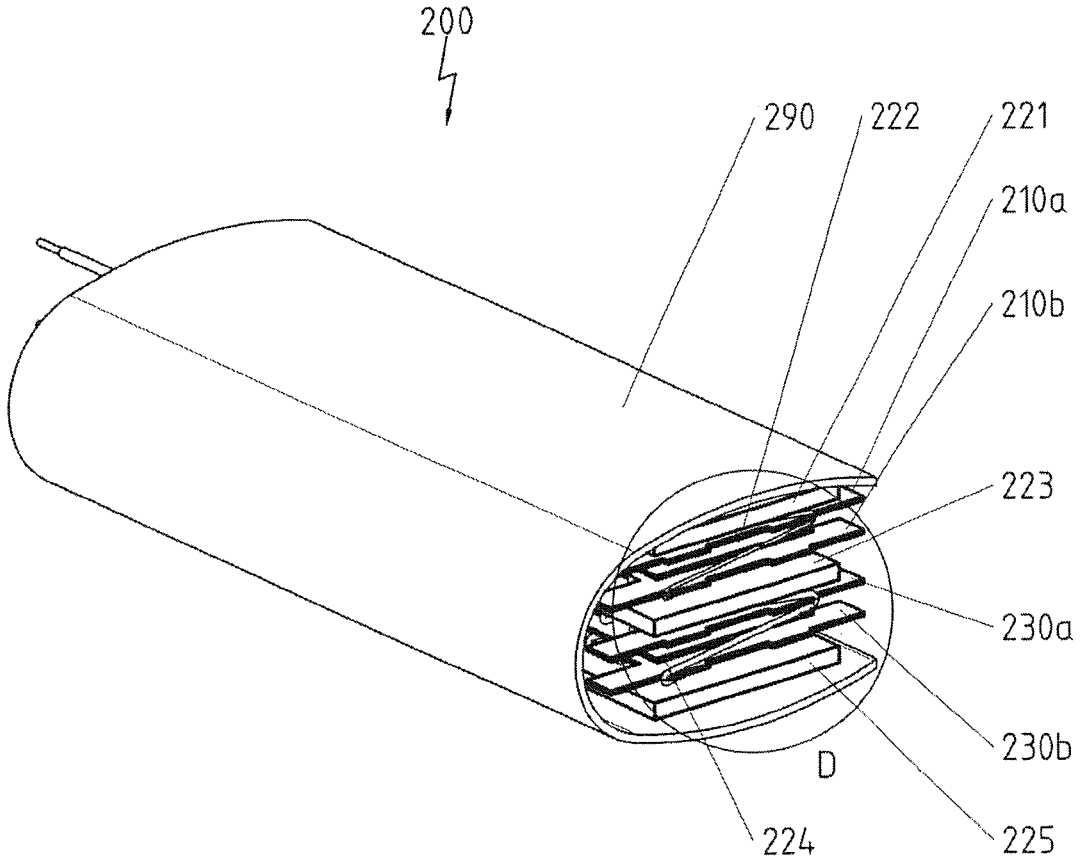
FIG. 4*c* is another perspective view of a second device for converting electricity into heat.
Figure 4D:
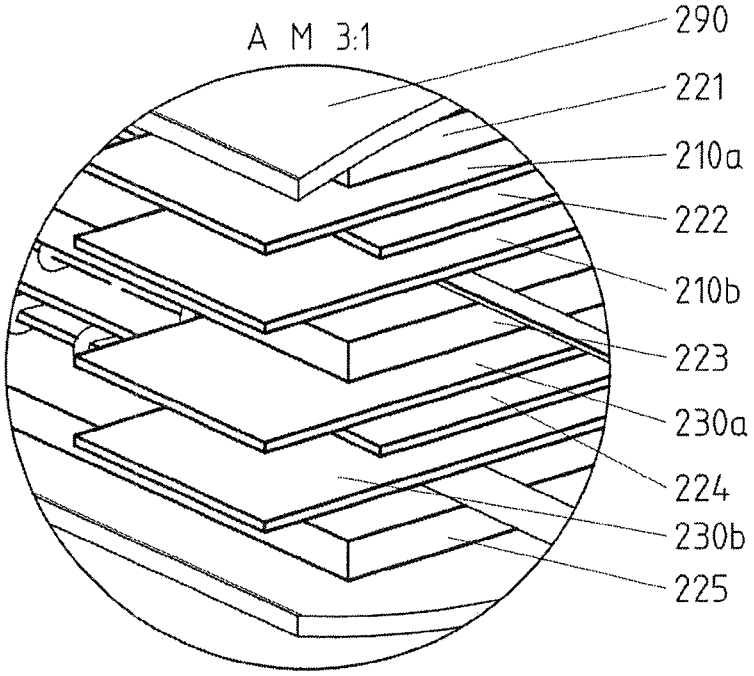
FIG. 4*d* is an enlarged detail from FIG. 4*a;*
Figure 4E:
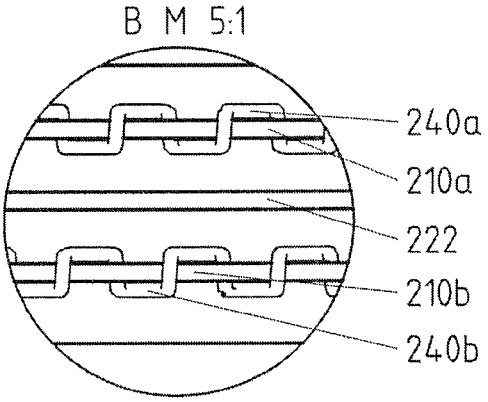
FIG. 4*e* is a first enlarged detail from FIG. 4*b;*
Figure 4F:
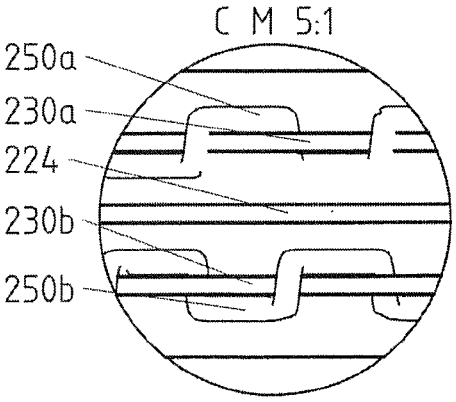
FIG. 4*f* is a second enlarged detail from FIG. 4*b;*

As it becomes especially clear in the enlarged details enlarged on the same scale, which are shown as FIGS. 4*e* and 4*f*, the electric heating elements 240*a* and 240*b* have different configurations compared to the electric heating elements 250*a* and 250*b* both in terms of their cross section and in terms of the winding pattern, especially the number of turns and the winding pitch, so that two heating circuits with different heat outputs are present, which permit different operating stages depending on the actuation or can also be used with different voltage sources, e.g., with the on-board voltage network of a vehicle, on the one hand, and with the normal electric a.c. voltage network, on the other hand.

While the use of rectangular or strip-shaped winding supports 210*a*, 210*b*, 230*a*, 230*b* is also possible, in principle, these have respective projections 211*a*, 211*b*, 212*a*, 212*b*, 231*a*, 231*b*, 232*a*, 232*b*, which locally broaden each winding support 210*a*, 210*b*, 230*a*, 230*b*, in the exemplary embodiment shown, the broadening being symmetrical in this exemplary embodiment. It is ensured hereby, in particular, that the wound-on areas of the winding supports 210*a*, 210*b*, 230*a*, 230*b* are spaced apart from the housing 290.

The possibility of providing an electrical connection of the two ends of the electric heating elements 240*a*, 240*b* and 250*a*, 250*b* on the same side of the device 200 for converting electricity into heat is made possible here by the arrangement of these heating elements in pairs, in which the respective electric heating elements 240*a* and 240*b* as well as 250*a* and 250*b* are connected in series. This can be embodied in an especially simple manner by simply using the same electric heating element or the same heating wire for both windings, as is seen especially clearly in FIGS. 4*h* and 4*j*.

Figure 4G:
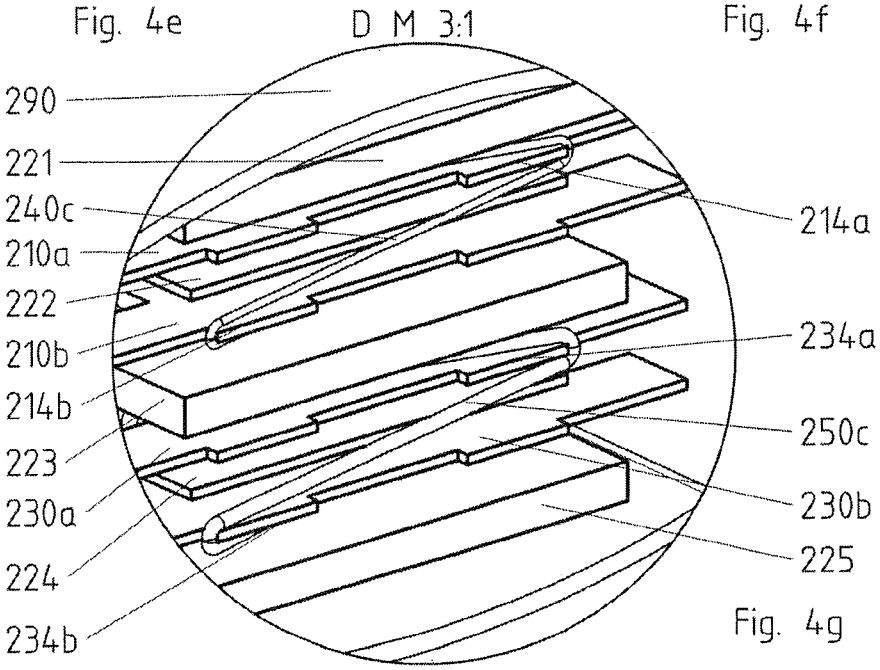
FIG. 4*g* is an enlarged detail from FIG. 4*c;*

It is therefore especially advantageous to provide projections 214*a*, 214*b*, 234*a*, 234*b* on the end face located opposite the terminals, via which projections a connection section 240*c* and 250*c*, respectively, of the electric heating element can then be led, which can be seen especially clearly in the enlarged detail shown in FIG. 4*g*.

The electric heating elements 240*a*, 240*b*, 250*a*, 250*b* are then contacted each via contact points 213*a*, 213*b*, 233*a*, 233*b* provided on the winding supports 210*a*, 210*b*, 230*a*, 230*b*, via which a contact is established to a terminal wire 241*a*, 241*b*, 251*a*, 251*b*.

Figure 4H:
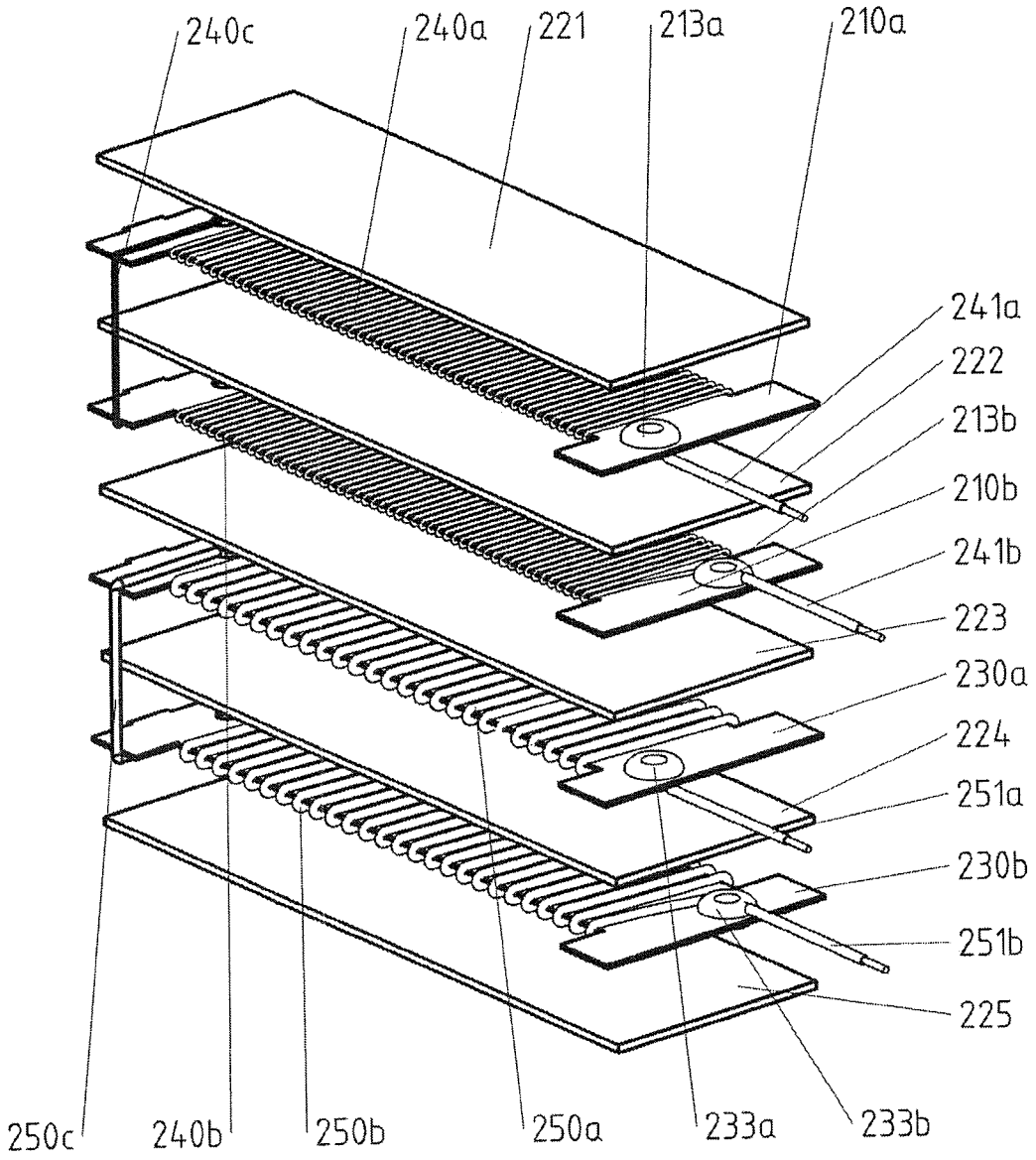
FIG. 4*h* is a perspective exploded view of the stacked arrangement of the device for converting electricity into heat from FIG. 4*a;*
Figure 4J:
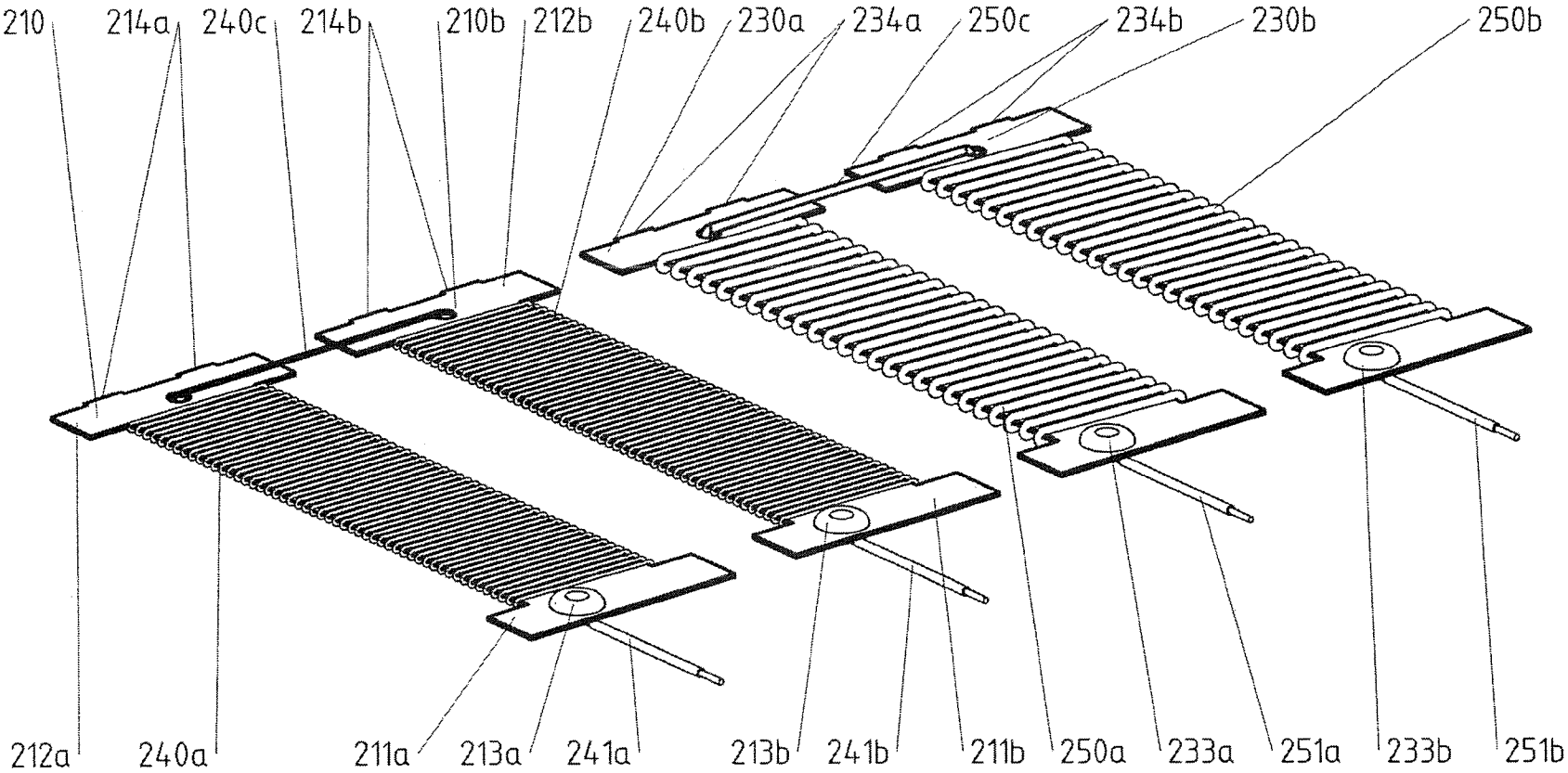
FIG. 4*j* is a perspective view showing a wound-on winding support, preconfigured for use in the device for converting electricity into heat according to FIG. 4*a;*

As is seen especially clearly in FIG. 4*h* and in the enlarged detail that is shown in FIG. 4*d*, the wound-on winding supports 210*a*, 210*b*, 230*a*, 230*b* are arranged in the device 200 for converting electricity into heat one on top of another and area part of a stack, which also contains, moreover, electrically insulating insulation plates 221, 222, 223, 224, 225, which should preferably have the best possible heat conduction. The insulation plates 221, 222, 223, 224, 225 may consist, for example, of Micanite.

The respective electric heating elements 240*a*, 240*b* and 250*a*, 250*b* belonging to one heating circuit are electrically insulated from one another by the insulation plates 222 and 224 such that short-circuits between the respective windings are avoided. The insulation plate 223 ensures this for the electric heating elements 240*b* and 250*a*, which are arranged adjacent to one another but belong to different heating circuits, while the electrical insulation of the electric heating elements 240*a* and 250*b* from the housing 290 is ensured by the insulation plates 221 and 225. Individual insulation plates or all the insulation plates 221, 222, 223, 224, 225 may, however, also be replaced, in principle, by embedding the electric heating elements 240*a*, 240*b*, 250*a*, 250*b* in an electrically insulating, but heat-conducting power or granular material, for example, magnesium oxide, for insulation from one another and from the housing 290. The overall arrangement is preferably compressed together in both cases. This may preferably lead to a gap-free arrangement, in which the electric heating elements are then especially also pressed into the insulation support and/or the winding support.

A stack configuration expanded according to this configuration principle may, of course, also have even more heating circuits.

Figure 5A:
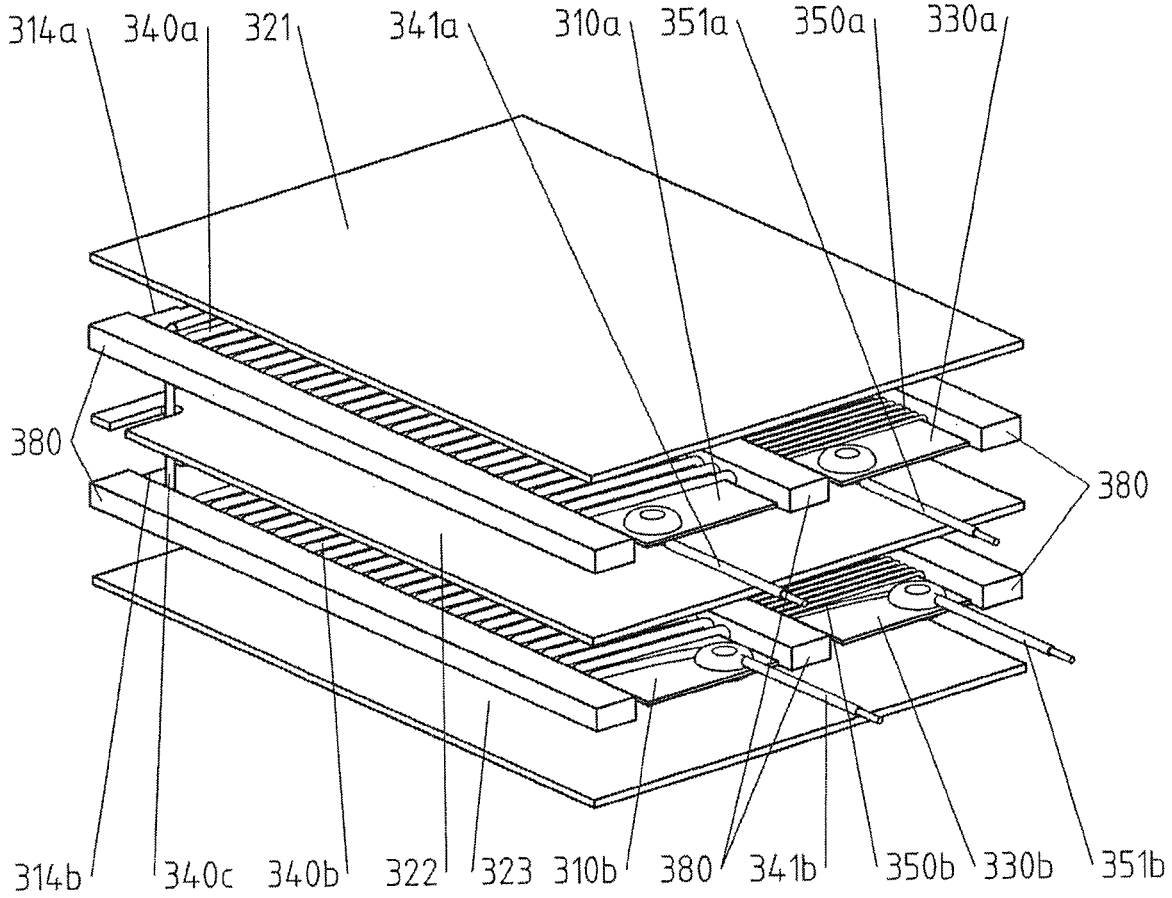
FIG. 5*a* is a perspective partially opened exploded view showing another variant of a stacked arrangement for use in a device for converting electricity into heat.
Figure 5B:
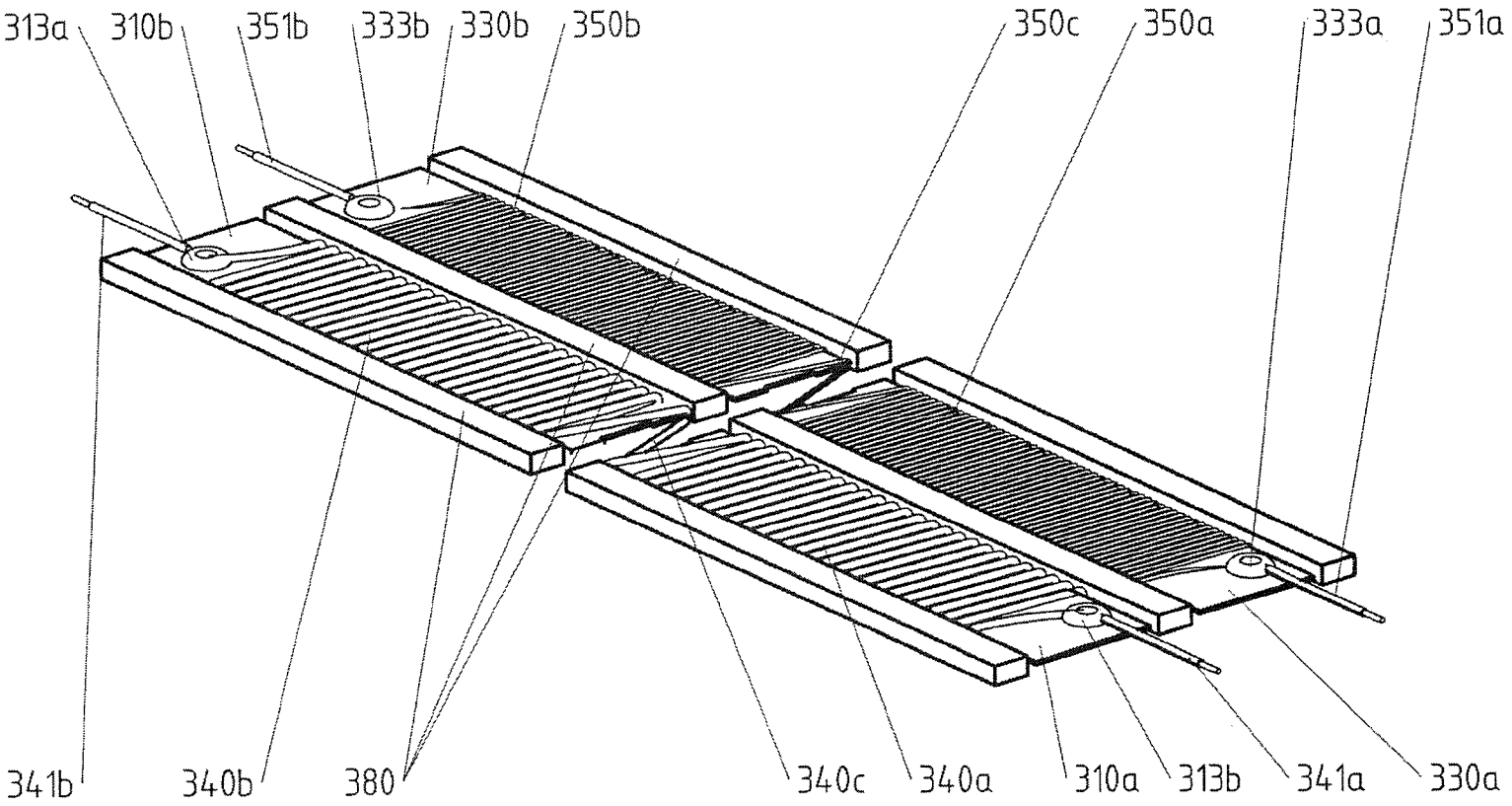
FIG. 5*b* is a perspective view showing a wound-on winding support preconfigured for use in the variant according to FIG. 5*a;*

FIGS. 5*a* and 5*b* show yet another variant of the arrangement of wound-on winding supports, which can be used for devices according to the present invention.

Four winding supports 310*a*, 310*b*, 330*a*, 330*b*, on which a respective electric heating element 340*a*, 340*b*, 350*a*, 350*b* is wound in the form of a heating conductor, are present here as well, and the electric heating elements 340*a* and 340*b*, on the one hand, and the electric heating elements 350*a* and 350*b*, on the other hand, are connected in series, so that two heating circuits are likewise formed, but they are arranged next to one another rather than one on top of another in this variant.

Essentially rectangular or strip-shaped winding supports 310*a*, 310*b*, 330*a*, 330*b* are used in this example; an electrical insulation in the lateral direction is brought about by bar-shaped insulation strips 380.

The possibility of establishing an electrical connection of both ends of the electric heating elements 340*a*, 340*b* and 350*a*, 350*b* on the same side is made possible by the arrangement of said heating elements in pairs here as well, in which arrangement the respective heating elements 340*a* and 340*b* as well as 350*a* and 350*b* are connected in series. This can takes place by the provision of projections 314*a*, 314*b*, 334*a*, 334*b* on the end face located opposite the terminals here as well, over which projections a connection section 340*c* and 350*c* of the respective electric heating element is then led.

The electric heating elements 340*a*, 340*b*, 350*a*, 350*b* are then contacted again via contact points 313*a*, 313*b*, 333*a*, 333*b* provided on the winding supports 310*a*, 310*b*, 330*a*, 330*b*, at which contact points a respective contact is established to a terminal wire 341*a*, 341*b*, 351*a*, 351*b*.

As is seen especially clearly in FIG. 5*a*, the wound-on winding supports 310*a*, 310*b*, 330*a*, 330*b* are arranged in pairs one on top of another in the device 300 for converting electricity into heat and thus form a part of the stack, which also contains, moreover, electrically insulating insulation plates 321, 322, 323, which should preferably have the best possible heat conduction. The insulation plates 321, 322, 323 may consist, for example, of Micanite.

The respective electric heating elements 340*a*, 340*b* and 350*a*, 350*b* belonging to one heating circuit are insulated electrically from one another by the insulation plate 322 such that short-circuits between the respective windings are avoided. The electrical insulation of the electric heating elements 340*a* and 350*a* as well as 340*b* and 350*b* from the housing, not shown, is ensured by the insulation plates 321 and 323, respectively.

Figure 6A:
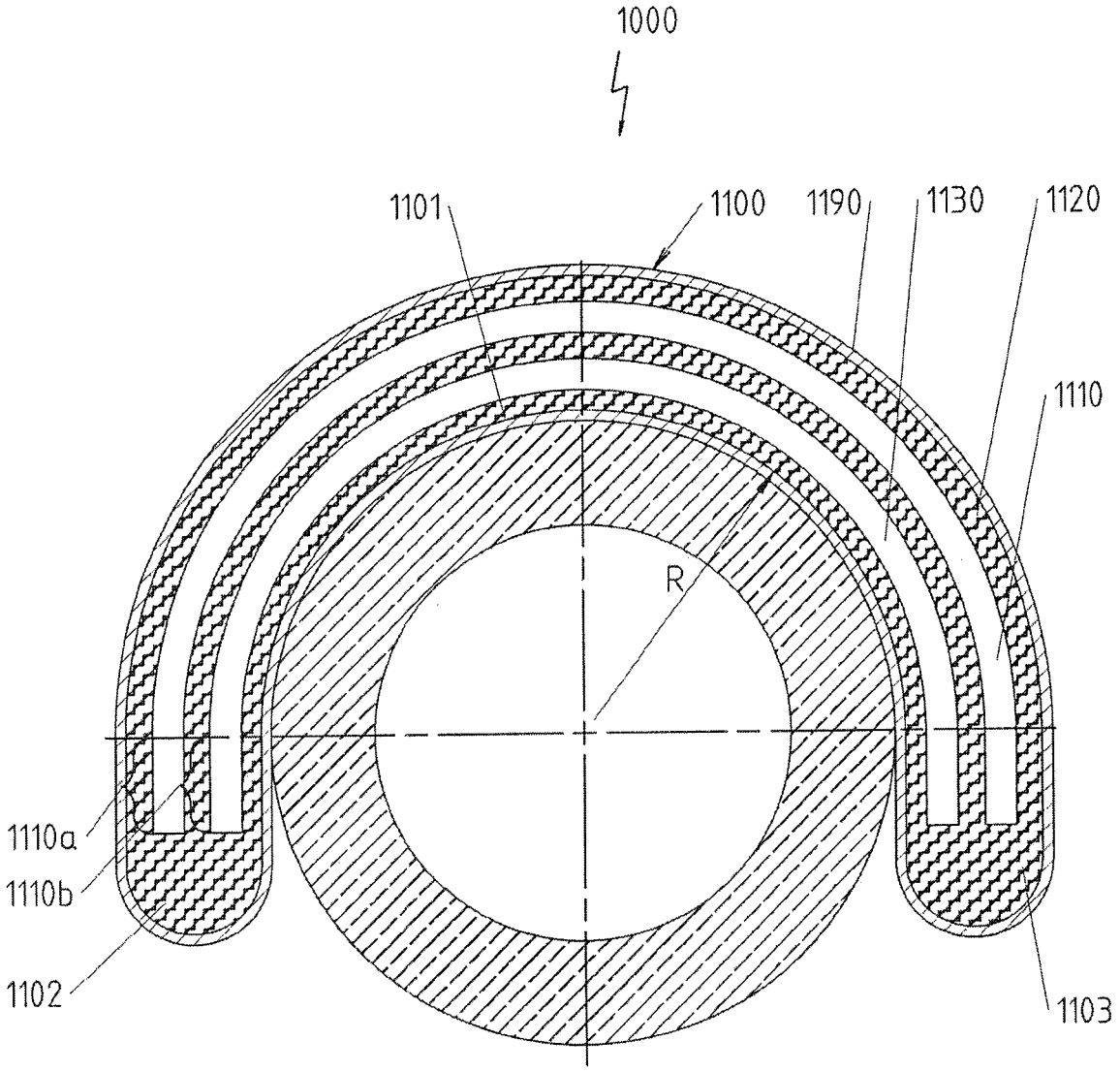
FIG. 6*a* is a schematic view of the cross section of a first exemplary embodiment of an electric heater for heating a pipe.

FIG. 6*a* shows a schematic view of an electric heater 1000 for heating a pipe 1001 with an external radius R in the cross section, wherein the plane of the cross section is located at right angles to the extension direction of the pipe 1001, i.e., at right angles to the direction in which a liquid flows through the pipe 1001. A device 1100 for converting electricity into heat, which corresponds in terms of the wound-on winding support 1110, 1130 and the arrangement thereof in the housing 1190 to the exemplary embodiment shown in FIGS. 1 and 2, is used, but the electric heating elements wound on the winding supports 1110, 1130 are not shown to improve clarity. Unlike in the exemplary embodiment according to FIGS. 1 and 2, the insulation of the winding supports 1110, 1130 and of the windings of the electric heating elements, not shown, which are arranged on them, from one another and from the housing 1190 is not ensured by the use of insulation plates, but by the use of insulation powder 1120, especially magnesium oxide.

Depending on how the electric heating elements, not shown, are configured, especially in terms of the selection of the material and the cross section, and on how the winding supports 1110, 1130 are wound on, especially in terms of the number of turns and the winding pitch, heating circuits with different heat outputs can thus be provided in a very simple manner, which permit different operating stages depending on the actuation, or it is also possible to provide heating circuits for use with different voltage sources, e.g., the on-board voltage network of a vehicle, on the one hand, and the normal, stationary a.c. voltage network, on the other hand.

The device 1100 for converting electricity into heat was shaped to assume a U-shape, in which the arc 1101 of the U, which connects the legs 1102, 1103 of the U, follows a semicircular contour, which is adapted to the external radius R of the pipe 1001.

It is seen at the same time that a respective section 1110*a*, 1110*b*, 1130*a*, 1130*b* of the wound-on winding support 1110, 1130 also extends in the area, which is formed by the legs 1102, 1103 of the U and which extends over the center of the cross section of the pipe 1001. Not only is thus the mechanical seating of the device 1100 for converting electricity into heat on the pipe 1001 to be heated improved by the legs 1102, 1103 of the U, but it is also ensured that the part of the circumference of the pipe, via which heat can be introduced, is also enlarged or maximized.

Figure 6B:
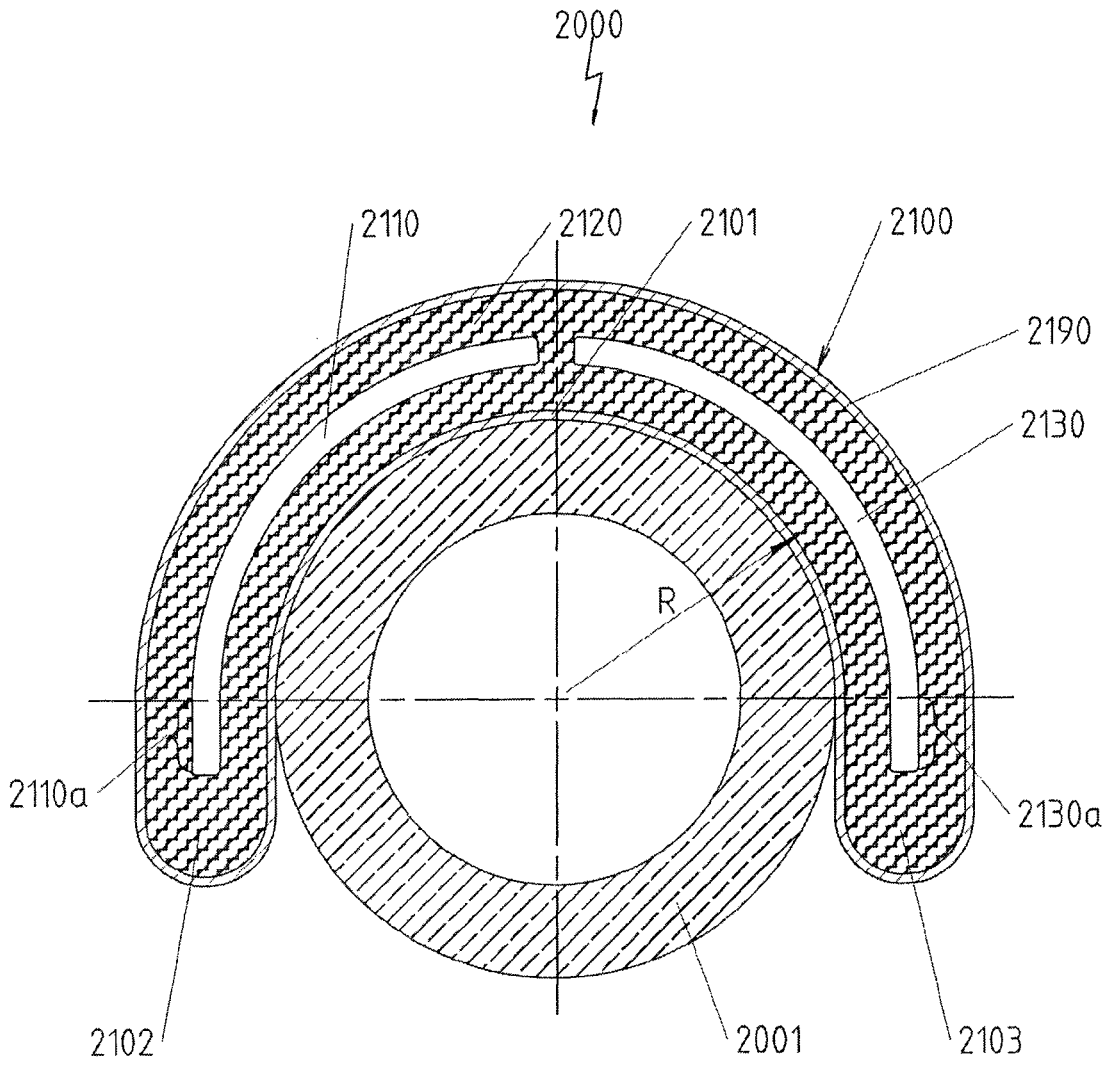
FIG. 6*b* is a schematic view of the cross section of a second exemplary embodiment of an electric heater for heating a pipe.

The exemplary embodiment of an electric heater 2000 for heating a pipe 2001 with an external radius R, which exemplary embodiment is shown in FIG. 6*b* in the same perspective as the perspective in FIG. 7*a*, likewise has a device 2100 for converting electricity into heat with a housing 2190 and with two wound-on winding supports 2110, 2130, whose windings are not shown for the sake of clarity and which are electrically insulated from the housing 2190 and from one another by insulation powder 2120, especially magnesium oxide.

The device 2100 for converting electricity into heat was shaped for this purpose such that it assumes a U-shape, in which the arc 2101 of the U, which connects the legs 2102, 2103 of the U, follows a semicircular contour, which is adapted to the external radius R of the pipe 2001, wherein a respective section 2110*a*, 2130*a* of the wound-on winding supports 2110, 2130 also extends in the area formed by the legs 2102, 2103 of the U, which area extends over the center of the cross section of the pipe 2001, which leads to the same effects as in the case of the electric heater 2000.

However, the electric heater 2000 differs from the electric heater 1000 in terms of the arrangement of the wound-on winding supports 2110, 2130, which are not stacked here, but are arranged next to one another each in a half of the U. This leads to an electric heater 2000, which leads only to a smaller enlargement of the cross section of the pipe in the area being heated with it and is thus well suited precisely for use in a small available installation space in this dimension.

Figure 7:
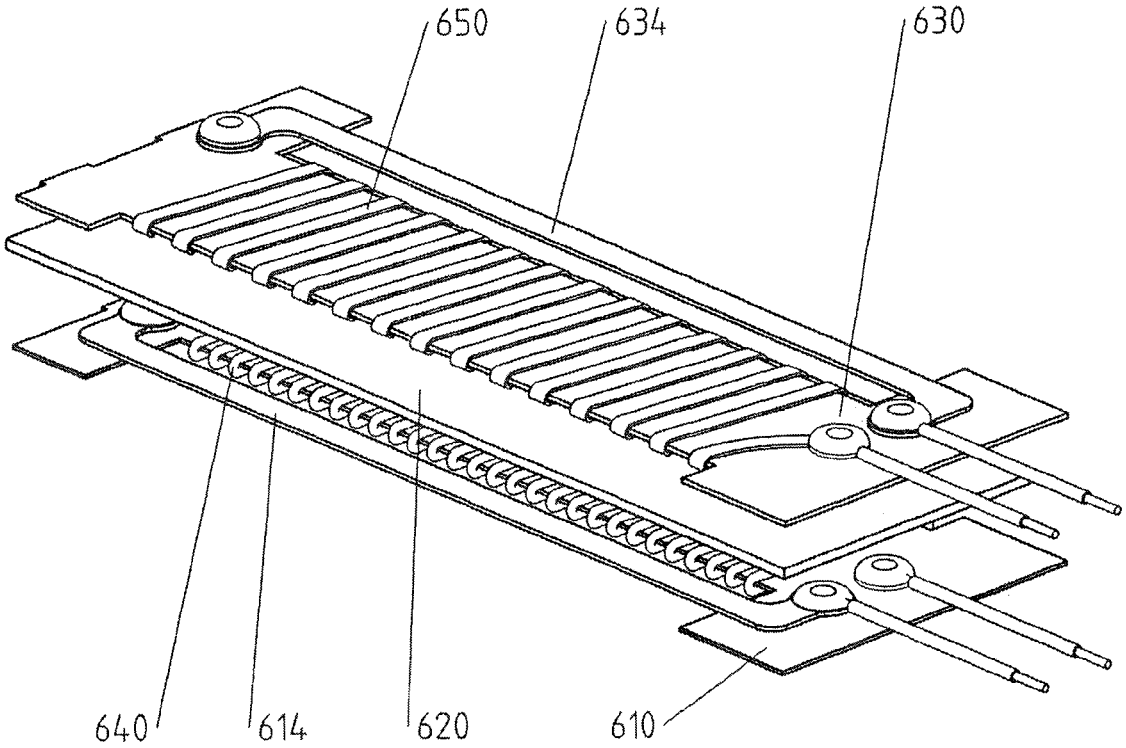
FIG. 7 is a perspective view showing another variant of a stacked arrangement for use in a device for converting electricity into heat.

The variant of a stacked arrangement shown in FIG. 7 arises essentially from a different arrangement of wound-on winding supports, which are very similar to the winding supports shown in FIG. 2, namely, to an arrangement one on top of another rather than next to one another.

FIG. 7 shows two winding supports 610, 630, on which are wound a respective electric heating element 640, 650 in the form of a heat conductor, and which are galvanically separated from one another by an insulation plate 620. The electric heating elements 640, 650 differ from one another here especially in terms of their cross section.

The two ends of the electric heating elements 640, 650 are connected electrically on the same side of the winding supports 610, 630 in this example as well, but the return is via return plates 614, 634 here, which extend on different sides of the electric heating elements 640, 650.

Figure 8A:
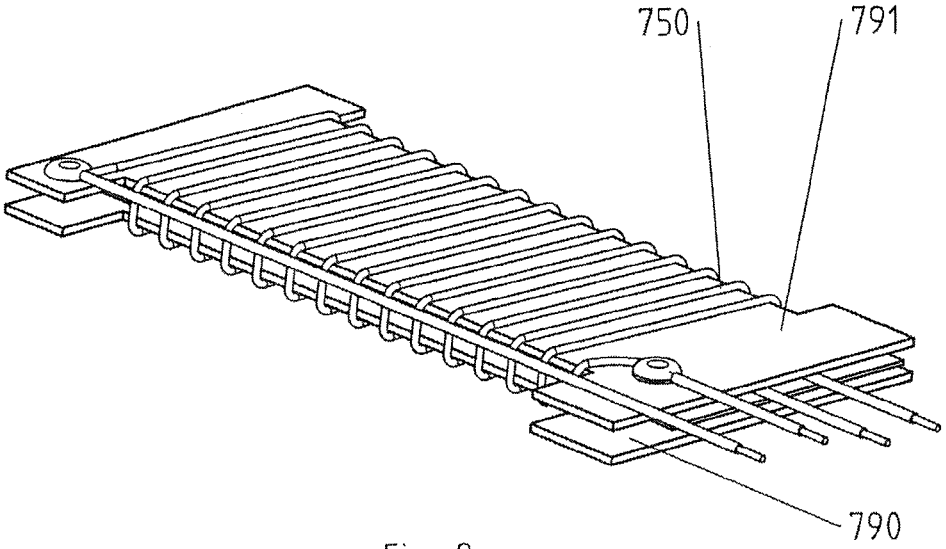
FIG. 8*a* is a perspective view showing another variant of a stacked arrangement for use in a device for converting electricity into heat.
Figure 8B:
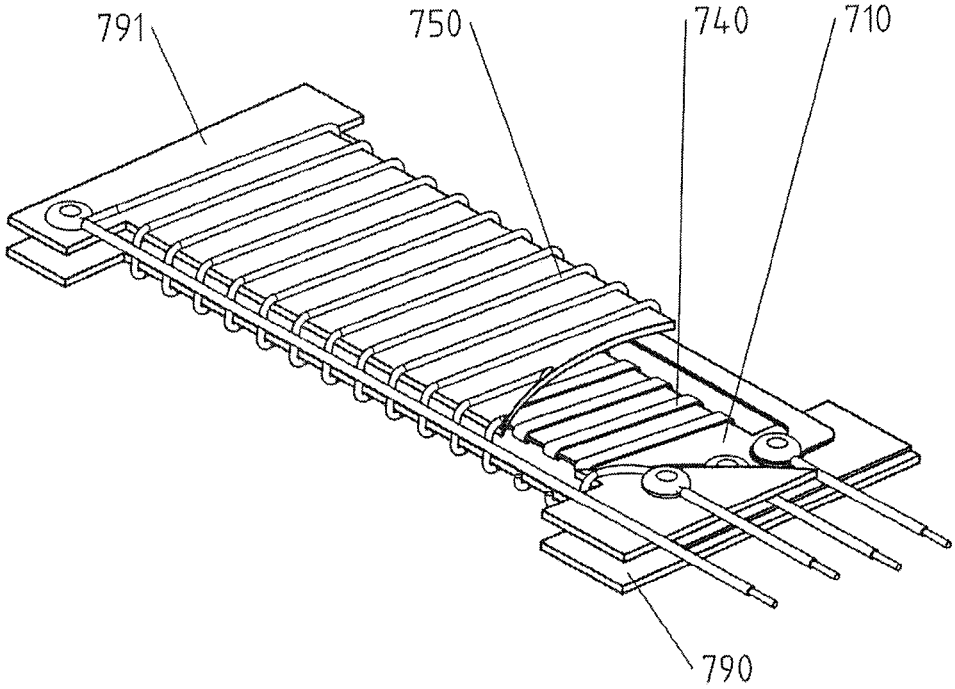
FIG. 8*b* shows a partially cut away view of the stacked arrangement from FIG. 8*a*.

A "sandwich-like" arrangement of the electric heating elements 740, 750 is formed in the exemplary embodiment that is shown in FIGS. 8*a* and 8*b*. The inner electric heating element 740, configured for the operation with a higher output, is wound for this purpose onto a winding support 710, which is located between two insulation plates 790, 791, which are each broader than the wound-on winding support 710 and together form the winding support for the electric heating element 750, on the one hand.

While specific embodiments of the invention have been shown and described in detail to illustrate the application of the principles of the invention, it will be understood that the invention may be embodied otherwise without departing from such principles.

APPENDIX

List of Reference Designations:

100, 200, 1100, 2100 Device

110, 130, 210*a*, 210*b*, 230*a*, 230*b*, 310*a*, 310*b*, 330*a*, 330*b*, 510, 610, 630, 710, 1110, 1130, 2110, 2130 Winding support

111, 112, 131, 132 End area

111*a*, 111*b*, 112*a*, 112*b*, 131*a*, 131*b*, 132*a*, 132*b*, 211*a*, 211*b*, 212*a*, 212*b*, 214*a*, 214*b*, 231*a*, 231*b*, 232*a*, 232*b*, 234*a*, 234*b*, 314*a*, 314*b*, 334*a*, 334*b* Projection

113, 133, 213*a*, 213*b*, 233*a*, 233*b*, 514, 515 Contact point

120,121, 122, 221, 222, 223, 224, 225, 321, 322, 323, 590, 591, 620, 790, 791 Insulation plate

141, 142, 151, 152, 241*a*, 241*b*, 251*a*, 251*b*, 341*a*, 341*b*, 351*a*, 351*b*, 541, 542 Terminal wire

140, 150, 240*a*, 240*b*, 250*a*, 250*b*, 340*a*, 340*b*, 350*a*, 350*b*, 540, 640, 650, 740, 750 Electric heating element

190, 290, 1190, 2190 Housing

380 Insulation strip

543 End section

1000, 2000 Electric heater

1001, 2001 Pipe

1101, 2101 Arc of the U

1102, 1103, 2102, 2103 Leg of the U

1110*a*, 1110*b*, 1130*a*, 1130*b*, 2110*a*, 2130*a* Section

1120, 2120 Insulation powder

R External radius

What is claimed is:

1. A device for converting electricity into heat, the device comprising:

a housing;

a first flat winding support comprised of an electrically insulating material;

first electrical insulation;

a first electric heating element wound on the first flat winding support, the first electrical heating element supported in a wound state on the first flat winding support, being disposed in the housing and electrically insulated relative to the housing by the first electrical insulation;

a second flat winding support comprised of an electrically insulating material;

second electrical insulation;

further electrical insulation;

a second electric heating element wound on the second flat winding support galvanically separated from the first electric heating element by the further electrical insulation, the second electric heating element being disposed in the housing and electrically insulated relative to the housing by the second insulation such that first electric heating element and the second electric heating element are electrically insulated relative to the housing, wherein the first and second flat winding supports and the first and second electric heating elements are arranged in a stack inside the housing, the first electric heating element having terminals and the second electric heating element having terminals, the first electric heating element terminals being provided separate from the second electric heating element terminals, both of the first electric heating element terminals being located at a same end of the first flat winding support, the second electric heating element terminals being located at a same end of the second flat winding support;

each of the first and second electrical heating elements having a first end and an opposite second end, respective said terminals of the each electrical heating element being located at the respective first end, the each electrical heating element having a winding with a first terminal end, a wound portion and a second terminal end, the each first terminal end being arranged at the respective first end of the respective one electrical heating element, the each wound portion extending from the first end of the respective one electrical heating element to the second end of the respective one electrical heating element, the wound portion being wound around the respective flat winding support, the each second terminal end extending from the second end of the respective each electrical heating element to the first end of the respective each electrical heating element, and extending adjacent to the wound portion, respective, the second terminal end of the first electrical heating element being on a return side of the first electrical heating element, the second terminal end of the second electrical heating element being on a return side of the second electrical heating element, the return sides of the first and second electrical heating elements being on different sides of the housing.

2. A device for converting electricity into heat in accordance with claim 1, wherein the further electrical insulation has a higher dielectric strength than the first and second electrical insulation.

3. A device for converting electricity into heat in accordance with claim 1, wherein the first and second electrical insulation and the further insulation each comprises at least one insulation plate consisting of an electrically non-conductive material or, at least one web, made of an insulation mat or an insulation film and consisting of an electrically non-conductive material, arranged between respective electric heating elements arranged in the stack for insulating the first and second electric heating elements from one another.

4. A device for converting electricity into heat in accordance with claim 3, wherein the at least one insulation plate or at least one web comprises a plurality of insulation plates or webs.

5. A device for converting electricity into heat in accordance with claim 1, wherein the first electric heating element and the second electric heating element comprise a different pattern winding, possess different physical properties, possess different cross sections or consist of different materials.

6. A device for converting electricity into heat in accordance with claim 1, wherein at least one of the flat winding supports has a multipart configuration and is formed as a stack of insulation plates.

7. A device for converting electricity into heat in accordance with claim 6, further comprising:

another winding support; and another electric heating element, wound on the another winding support, located between two insulation plates of the multipart flat winding support.

8. A device for converting electricity into heat in accordance with claim 7, wherein the housing has a heating side configured to heat a body;

a low one of the first and second electric heating elements and the another electric heating element is of a lower heat output or is for operation with a lower operating voltage, and a high one of the first and second electric heating elements and the another heating element is of a higher heat output or is for operation with a higher operating voltage, the high one of the heating elements being arranged closer to the heating side of the housing than the low one of the heating elements.

9. A device for converting electricity into heat in accordance with claim 1, wherein:

each of the first and second electric heating elements are configured to be individually electrically selectable to provide heat;

the housing surrounds the stack on five sides of the stack.

10. A device for converting electricity into heat in accordance with claim 1, wherein:

each of the first and second electric heating elements are configured to be individually electrically selectable to provide heat;

the housing completely surrounds the stack.

* * * * *